United States Patent [19]

Sayre et al.

[11] 4,064,712

[45] Dec. 27, 1977

[54] WARP KNIT PRODUCT AND PROCESS

[75] Inventors: James Franklin Sayre; Karl Harvey Smale, both of Wilmington, Del.

[73] Assignee: E. I. Du Pont de Nemours and Company, Wilmington, Del.

[21] Appl. No.: 760,936

[22] Filed: Jan. 21, 1977

[51] Int. Cl.[2] ..... D04B 23/08; D04B 23/10

[52] U.S. Cl. ..... 66/192; 66/190

[58] Field of Search ..... 66/190, 191, 192, 193, 66/194, 195

[56] References Cited

U.S. PATENT DOCUMENTS

| | | | |
|---|---|---|---|
| 471,349 | 3/1892 | Cooper | 66/192 |
| 3,453,844 | 7/1969 | Heij | 66/192 |
| 3,552,154 | 1/1971 | Lesley | 66/192 |
| 3,859,825 | 1/1975 | Foulquies | 66/192 |
| 3,910,075 | 10/1975 | Holliday | 66/190 |
| 3,922,888 | 12/1975 | Patterson | 66/192 |

OTHER PUBLICATIONS

Reis feld, A. "Warp Knitting Engineering", N.Y., Nat. Ktd. Outw'r Assoc., 1966, pp. 338–339.

*Primary Examiner*—Ronald Feldbaum

[57] ABSTRACT

A warp knit two-way stretch fabric is formed by knitting a ground construction of inelastic yarn in a two-needle overlap pattern and laying elastic yarn into each course of the ground construction, the laying-in motion exceeding the underlap motion for the inelastic yarn in the same direction in the same course by one needle of the knitting machine. In the resultant fabric, each end of laid-in elastic yarn lies substantially parallel to the wales of the ground construction and is covered in each course by a full wrap of an underlap segment and a half wrap of the segment interconnecting the two loops formed by the two-needle overlap of the inelastic yarn.

9 Claims, 4 Drawing Figures

WARP KNIT PRODUCT AND PROCESS

BACKGROUND OF THE INVENTION

This invention is directed to warp-knit two-way stretch fabrics wherein the elastic yarn is laid into the fabric.

Elastic warp-knit fabrics in which the elastic yarn is knit into the stitches of the fabric generally contain about 15%–20% by weight of such yarn in order to display sufficient stretch and recovery power. The cost of such fabrics can be reduced by use of a lower elastic yarn content, as could be obtained by laying the elastic yarn into the fabric rather than knitting the yarn thereinto. However, the laid-in construction usually has the disadvantage of elastic yarn stripback (slippage). U.S. Pat. No. 3,552,154 discloses a warp-knit two-way stretch fabric containing laid-in elastic yarns in which the ground construction consists of a pair of inelastic yarns, and one of these inelastic yarns makes a full wrap around the elastic yarn in every two courses of the ground construction for the purpose of avoiding stripback. Among the disadvantages of this fabric, however, are the expense of the need to use a three-bar knitting machine to produce the fabric and for some applications, the cover of the elastic yarn by the inelastic yarn, and the opacity of the fabric is less than desired.

SUMMARY OF THE INVENTION

The present invention overcomes these disadvantages by providing a two-way stretch fabric of improved cover and opacity which can be knit more economically on a two-bar tricot or Raschel knitting machine.

More specifically, the fabric of the present invention can be described as comprising a ground construction of a plurality of ends of inelastic yarn knitted into stitches arranged in wales and courses interconnected by diagonal underlap segments of said yarn and a plurality of ends of elastic yarn laid into said ground construction, further details of the fabric construction being as follows:

a. The stitch pattern of the ground construction is such that each end of inelastic yarn has in each course a pair of loop segments in adjacent wales and a segment interconnecting the pair of loop segments.

b. The relationship of the ends of inelastic yarn in the ground construction is such that each stitch of the ground construction contains loops of two ends of inelastic yarn.

c. The relationship between the ground construction and laid-in elastic yarn is such that each end of elastic yarn is substantially parallel to the wales of the ground construction and is covered in each course thereof by a full wrap of one of said underlap segments and a half wrap of an interconnecting segment of said inelastic yarn.

The resultant fabric is a two-way stretch fabric. It can be made by knitting a ground construction of inelastic yarn from a fully threaded guide bar by overlapping and underlapping motions in each course of said ground construction, the overlapping motion being over two needles in each course and in opposite directions and including at least one different needle from course to course, laying elastic yarn into said ground construction from a fully threaded guide bar, the laying-in comprising in each course lapping said elastic yarn under one more needle than, and in the same direction as, the underlap motion of said inelastic yarn, and obtaining as a result thereof a full wrap and a half wrap of said elastic yarn by said inelastic yarn in each course of said fabric.

DETAILED DESCRIPTION

The fabrics of this invention can be made on a two-bar warp-knitting machine in which the back guide bar is fully threaded with elastic yarn and the front guide bar is fully threaded with inelastic yarn.

Figure 1A:
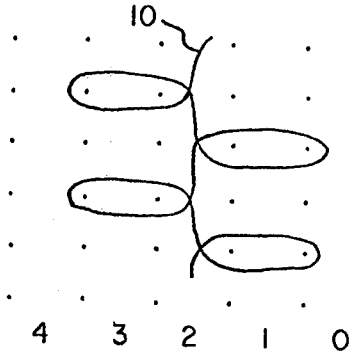
FIGS. 1*a* and 1*b* illustrate in a conventional point diagram one stitch pattern of a fabric of this invention showing the front and back guide bar motions, respectively, for producing such fabric.

One embodiment of ground construction of the fabric of the present invention is shown by the motion of the front guide bar with inelastic yarn 10 in FIG. 1*a*, i.e., to overlap two needles of the knitting machine in one direction in one course and in the opposite direction in the succeeding course and so on from course to course along the length of the fabric. This particular knitting motion in tricot knitters' notation is 2–0/2–4. The resultant ground construction of the fabric can be seen from FIG. 2 wherein the paths of three ends of inelastic yarns 10, 10', and 10'' are shown.

Figure 2:
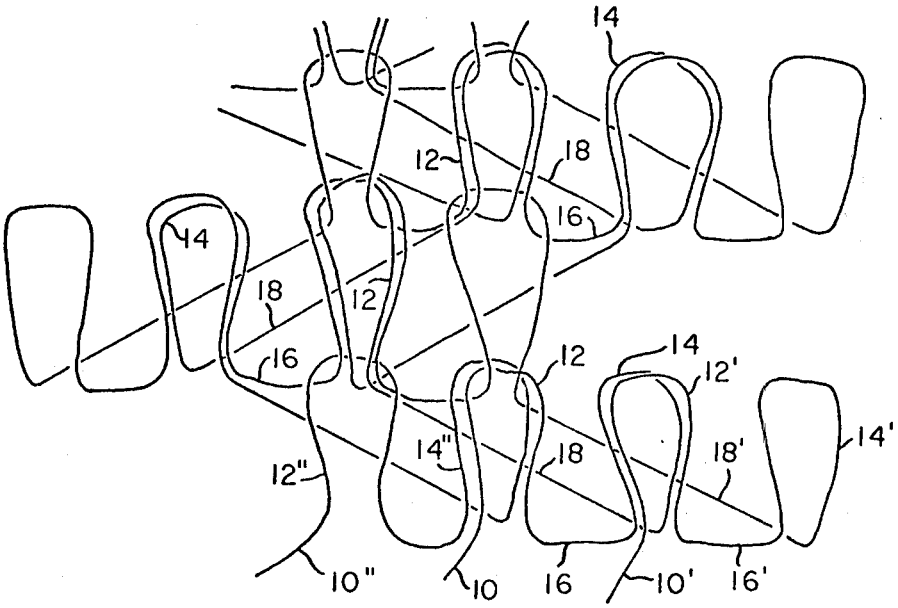
FIG. 2 is a diagrammatic plan view of a portion of the ground construction of the fabric having the stitch pattern shown in FIG. 1*a* as viewed from the loop side (technical face) of the fabric.

To describe the stitch pattern formed by the two-needle overlap in greater detail, yarn 10 is formed in each course of the fabric into a pair of loop segments 12 and 14, one loop in each wale of a pair of adjacent wales, and a segment 16 of yarn 10 interconnecting these loop segments as shown in FIG. 2. The segment 16 of yarn 10 interconnecting loop segments 12 and 14 can be called the sinker segment because this segment is engaged by the sinkers of the knitting machine.

A diagonal underlap segment 18 of yarn 10 connects this stitch pattern with the same stitch pattern in each succeeding course of the fabric. The yarn end forming the loop segments in one course runs in the opposite direction in forming the loop segments in the succeeding course.

In each course, the stitch pattern of one end of inelastic yarn partially overlaps the stitch pattern of the adjacent end of inelastic yarn. To illustrate, the stitch pattern of adjacent inelastic yarn 10'' includes loop segments 12'' and 14''. The loop segment 14'' is coextensive with loop segment 12 of yarn 10. Similarly, the stitch pattern of yarn 10' includes loop segments 12' and 14' and the loop segment 12' is coextensive with the loop segment 14 of yarn 10. Loop segments 12 and 14'' form one stitch of the ground construction and loop segments 12 and 12' form another stitch. Thus, each stitch of the ground construction has one loop each of two ends of inelastic yarn.

Various two-needle overlap stitch patterns useful in the present invention are illustrated on page 81 of *An Introduction to the Stitch Formations in Warp Knitting*, published by Employees Association Karl Mayer (1966). Of these patterns, it is desired that the stitch pattern of the same end of inelastic yarn not repeat itself (as a chain stitch) in the same wales at each succeeding course but rather the stitch pattern should repeat itself, preferably symmetrically, in zig-zag fashion from course to course. Thus, the underlap segment of each end of inelastic yarn is diagonal from course to course, and the loop segments of the stitch pattern in each course occupy at least one different wale from the loop segments of the stitch pattern of the same end of yarn in the succeeding course. The stitch pattern of the same yarn end preferably extends in opposite directions from course to course but can extend in the same direction for two successive courses before reversing direction. The choice of the particular two-needle overlap ground construction will be such as to achieve a certain relationship with the laid-in elastic yarn to be described hereinafter.

Figure 1B:
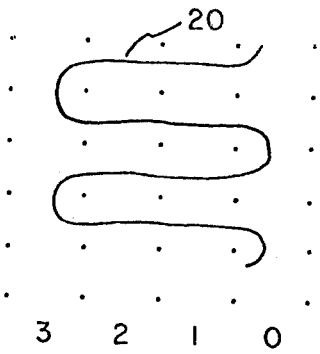

The present invention involves the combination of the aforesaid ground construction with a particular lay-in pattern of elastic yarn. One embodiment of the lay-in pattern of the elastic yarn 20 is shown in FIG. 1*b*. The knitting motion for this pattern is 0–0/3–3 in tricot knitters' notation. The elastic yarn is provided by a fully threaded back guide bar of the knitting machine. From FIG. 1*b* it can be seen that the knitting motion is a three-needle underlap of elastic yarn 20 in the same direction and the same course as the two-needle underlap motion of the inelastic yarn 10 shown in FIG. 1*a*. Thus, in accordance with the present invention, the underlap motion laying in the elastic yarn exceeds the underlap motion of the inelastic yarn in the same course by one needle of the knitting machine.

While the two-needle overlap used in the ground construction of the fabric of the present invention is a known stitch pattern, it is not a popular stitch pattern because of the tendency of this stitch pattern to increase yarn tension such that yarn breakage or even needle breakage can occur. The effect of superimposing laying elastic yarn under tension into the ground construction of this stitch pattern was not predictable in terms of the knitting machine even being able to operate.

When the fabric is allowed to relax on leaving the knitting machine, the elastic yarn which was laid in under tension contracts to a generally straight line which is substantially parallel to the wales of the ground construction. In so doing, the elastic yarn causes an unexpected wrapping around of the inelastic yarn of the ground construction to be explained hereinafter.

Figure 3:
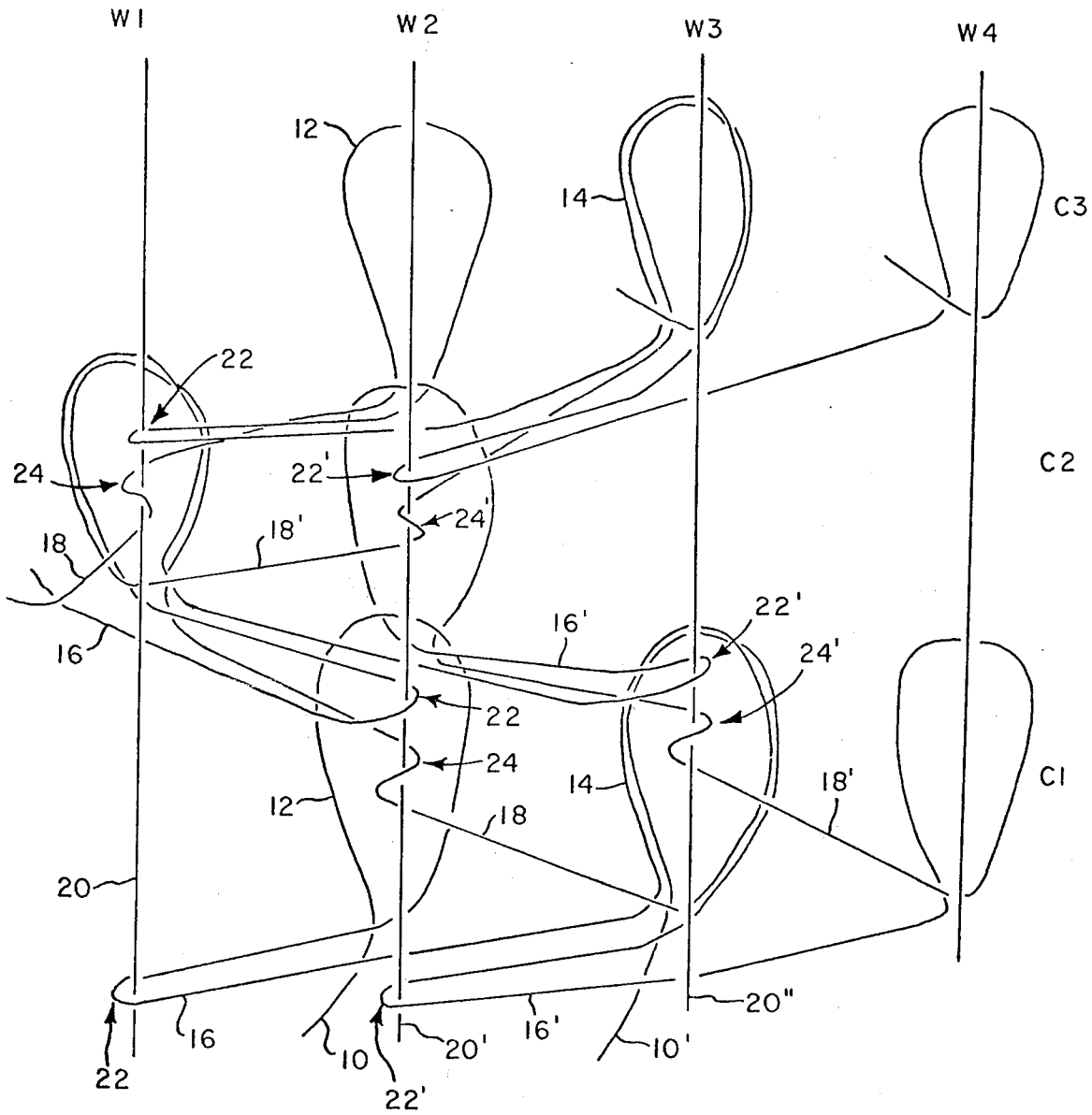
FIG. 3 is a diagrammatic plan view of a portion of the underlap side (technical back) of the ground construction of FIG. 2, including in addition, the laid-in yarn (elastic) of the stitch pattern of FIG. 1*b*.

FIG. 3 shows the resultant relationship between the inelastic yarn of the ground construction and the laid-in elastic yarn. In greater detail, FIG. 3 shows a portion of the fabric comprising two ends of inelastic yarn 10 and 10' and three ends of elastic yarn 20, 20', and 20'' in three courses designated C1, C2, and C3, respectively, and in four wales designated W1, W2, W3, and W4, respectively (one loop segment formed by yarn 10 in course C2 in the wale adjacent to W1 is not shown). With respect to the stitch pattern of yarn 10 in course C1, the interconnecting segment 16 of yarn 10 in course C2 makes a half wrap 22 around elastic yarn 20' in wale W2. The underlap segment 18 of yarn 10 in course C1 makes a full wrap 24 about the same elastic yarn 20' in wale W2. Similarly, in course C1, the interconnecting segment 16' of yarn 10' in course C2 makes a half wrap 22' about elastic yarn 20'' and the underlap segment 18' makes a full wrap 24' around elastic yarn 20''.

By "full wrap" is meant one complete turn of approximately 360° of the inelastic yarn about the elastic yarn, i.e., the inelastic yarn approaches and leaves the elastic yarn in substantially the same direction. By "half wrap" is meant a turn of the inelastic yarn about the elastic yarn of approximately 180°, such that the inelastic yarn approaches and leaves the elastic yarn in substantially opposite directions.

From the foregoing description, it will be noted that each end of inelastic yarn wraps around each end of elastic yarn in each course twice, one wrap being a half wrap and the other wrap a full wrap. The segments of the end of inelastic yarn doing the wrapping are separated by a loop segment in the succeeding course. The full wrap of an underlap segment and the half wrap of an interconnecting segment in every course recur alternately from course to course for a given end of elastic yarn as shown, for example, for elastic yarn 20' in FIG. 3.

With respect to adjacent ends of elastic yarn, the inelastic yarn covers one such end by a half wrap of the interconnectng segment in one course and the other of such adjacent ends by a full wrap of the underlap segment in the succeeding course.

U.S. Pat. No. 3,552,154 shows in FIG. 1 the full wrapping of inelastic yarn about elastic yarn in the fabric achieved by much different stitch pattern involving three yarns as shown in FIG. 2. Unexpectedly, the stitch pattern of the elastic and inelastic yarns used in the present invention provides not only the full wrap but also the half wrap of inelastic yarn about the elastic yarn. This greater amount of wrap in the fabric of the present invention provides greater cover of the inelastic yarn over the elastic yarn. In addition, the elastic yarn can be contained in the wale line of the fabric as shown in FIG. 3 instead of between the wale line as shown in FIG. 1 of the patent. This provides the fabric with a more uniform appearance when stretched and improves the cover of the elastic yarn viewed from the technical face of the fabric.

In producing the fabrics of the present invention, the underlap motion of the back guide bar supplying the elastic yarn is in the same direction as the underlap motion of the front guide bar and preferably over one additional needle space. The elastic yarn becomes contained in the wale line of the fabric when the amplitude of the underlap motion of the back guide bar is an odd number of needles. When, however, the amplitude of the underlap motion of the back guide bar is an even number of needles, the elastic yarn will lie between the wales of the ground construction after knitting. These dispositions of the elastic yarn arise when the fabric is taken from the knitting machine and relaxed. When the overlap knitting motion is not reversed from course to course but is in the same direction for two courses before reversal occurs, the back guide bar has a different motion than specified above. For example, for 2–4/3–1/4–2/0–2 motion for the front guide bar, the back bar motion would be 2–2/0–0/3–3/0–0 to form a fabric of the present invention.

The knitting motion of the guide bars is described herein in greater detail in terms of tricot knitters' notation, and the size of the overlap and underlap, respectively, is calculated following the usual practice explained by D. F. Paling in his text "Warp Knitting Technology", second edition, 1965. As taught at pages 72–73 of this publication, the knitting notation consists of pairs of numbers for each course, the pairs being separated by oblique lines. The direction and amplitude of the overlap for each course is determined by the difference between the first and last numbers of each pair. The direction and amplitude of the underlap for each course is determined by the difference between the last number of the pair for that course and the first number of the next pair. In other words, the difference between the numbers separated by oblique lines in the notation determines the size of the underlap. Thus, the notation of the stitch pattern of the front bar of Example 2 shows an underlap motion over one needle and, in accordance with the present invention, the underlap motion of the back bar supplying the inelastic yarn, is over two needles in the same direction.

The inelastic yarns useful in the fabrics of this invention have elongations at break of less than 100% and may be any conventional textile yarns, either continuous-filament (textured or nontextured) or staple yarns or combinations of the two types, including both synthetic fiber and natural fibers, such as nylon, polyester, wool, and cotton. The elastic yarn is preferably segmented polyurethane commonly known as spandex.

The fabrics of this invention can be prepared on either tricot or Raschel warp-knitting machines. Although the heavier deniers of spandex, for example, 140 denier and higher, would preferably be used on Raschel machines, the lighter deniers offer special advantages on tricot machines where the fabrics of this invention provide an economical replacement for the conventional two-bar elastic tricot jersey.

It should be noted that only a single guide bar is required to knit the ground structure of the fabric of this invention; thus, the fabric is easily knit on a two-bar machine.

The fabrics of this invention have outstanding "fabric cover", i.e., high opacity. The high opacity of the fabrics of this invention is attributed to the canted loop segments of the stitches (canting not shown in FIGS. 2 and 3 for sake of clarity) caused not only by the stitch pattern used but also by the retraction of the elastic yarn. In the relaxed state, the fabrics resemble woven fabrics.

The fabrics of this invention are useful in many types of elastic garments, for example, panties, girdles, briefs, outerwear, and swimwear.

The present invention is illustrated by the following Examples.

EXAMPLE 1

On a two-bar, 32-gauge, Mayer tricot warp knitting machine (213 cm fabric width) the front bar is fully threaded with 40 total denier, 13-filament, interlaced continuous-filament nylon yarn, and the back bar is fully threaded with 40-denier, coalesced multifilament spandex yarn. The front bar stitch pattern is 2–0/2–4, and the back bar stitch pattern is 0–0.3–3. The beam let-offs are adjusted such that the front bar runner length is 310 cm per rack and the back bar runner length is 20 cm per rack (from a beam of spandex yarn wound at 65% elongation). The fabric is knit at a quality of 22.9 courses per cm. The resultant fabric is finished in the relaxed state to yield an elastic fabric containing 20 wales per cm and 41 courses per cm and weighing 251 g/m². It contains 3.8% spandex and 96.2% nylon, the spandex yarns lying in the wale line of the ground construction. The fabric has good cover and is two-way stretchable.

EXAMPLE 2

The knitting machine of Example 1 is threaded as in that example and is adjusted so that the front bar stitch pattern is 2–0/3–3, and the back bar stitch pattern is 0–0/2–2. The runner lengths are adjusted to 239 cm per rack for the nylon and 18 cm per rack for the spandex. The fabric is knit at a quality of 22.9 courses per cm. After relaxed finishing, the elastic fabric contains 19 wales per cm and 43 courses per cm and weighs 183 g/m². It contains 4.5% spandex and 95.5% nylon, the spandex yarns lying between the wales of the ground construction. The fabric has good cover and is two-way stretchable.

Since many different embodiments of the invention can be made without departing from the spirit and scope thereof, it is to be understood that the invention is not to be limited except to the extent defined in the following claims.

What is claim is:

1. A warp-knit two-way stretch fabric comprising a ground construction of a plurality of ends of inelastic yarn knitted into stitches arranged in wales and courses interconnected by diagonal underlap segments of said inelastic yarn and a plurality of ends of elastic yarn laid into said ground construction, a. each end of said inelastic yarn having in each of said courses a pair of loop segments in adjacent wales of said wales and a segment interconnecting said pair of loop segments, b. each of said stitches having loops of two ends of said inelastic yarn, and c. each end of said elastic yarn being substantially parallel to said wales of said ground construction and being covered in each course thereof by a full wrap of one of said underlap segments and a half wrap of an interconnecting segment of said inelastic yarn.

2. The fabric of claim 1 wherein each said end of inelastic yarn extends in one direction in one of said courses and in the opposite direction in the succeeding course.

3. The fabric of claim 2 wherein said pair of loop segments of each said end of inelastic yarn in one of said courses occupies at least one different wale than the pair of loop segments of said end of inelastic yarn in the succeeding course.

4. The fabric of claim 1 wherein in each course of said ground construction, the interconnecting segment and underlap segment of each end of inelastic yarn make a half wrap and full wrap, respectively, around a single end of said elastic yarn.

5. The fabric of claim 1 wherein said full wrap and half wrap in each course alternate from course to course of said ground construction.

6. The fabric of claim 1 wherein said elastic yarn lies in the said wales of said ground construction.

7. The fabric of claim 1 wherein said elastic yarn lies between said wales of said ground construction.

8. A process for warp knitting a two-way stretch fabric comprising knitting a ground construction of inelastic yarn from a fully threaded guide bar by overlapping and underlapping motions in each course of said ground construction, the overlapping motion being over two needles in each course and in opposite directions and including at least one different needle from course to course, laying elastic yarn into said ground construction from a fully threaded guide bar, the laying-in comprising in each course lapping said elastic yarn under one more needle than, and in the same direction as, the underlap motion of said inelastic yarn, and obtaining as a result thereof a full wrap and a half wrap of said elastic yarn by said inelastic yarn in each course of said fabric.

9. The process of claim 8 wherein the knitting motion of the inelastic yarn is 2–0/2–4 and of the elastic yarn is 0–0/3–3.

* * * * *